US009272765B2

(12) United States Patent
Lindeborg

(10) Patent No.: US 9,272,765 B2
(45) Date of Patent: Mar. 1, 2016

(54) ROTATION AND TRANSLATION CONTROL SYSTEM FOR VESSELS

(75) Inventor: Mathias Lindeborg, Göteborg (SE)

(73) Assignee: CPAC SYSTEMS AB, V. Frölunda (SE)

( * ) Notice: Subject to any disclaimer, the term of this patent is extended or adjusted under 35 U.S.C. 154(b) by 0 days.

(21) Appl. No.: 14/378,296

(22) PCT Filed: Feb. 14, 2012

(86) PCT No.: PCT/SE2012/050154

§ 371 (c)(1),
(2), (4) Date: Sep. 26, 2014

(87) PCT Pub. No.: WO2013/122515

PCT Pub. Date: Aug. 22, 2013

(65) Prior Publication Data

US 2015/0032305 A1 Jan. 29, 2015

(51) Int. Cl.

| | |
|---|---|
| ***B63H 21/21*** | (2006.01) |
| ***B63H 25/20*** | (2006.01) |
| ***B63H 20/12*** | (2006.01) |
| ***B63H 25/42*** | (2006.01) |
| ***B63H 25/02*** | (2006.01) |
| ***B63H 23/08*** | (2006.01) |

(52) U.S. Cl.

CPC ..... *B63H 25/42* (2013.01); *B63H 21/21* (2013.01); *B63H 23/08* (2013.01); *B63H 25/02* (2013.01); *B63H 20/12* (2013.01)

(58) Field of Classification Search

CPC ..... B63H 25/02; B63H 25/42; B63H 23/08; B63H 21/21; B63H 20/12

See application file for complete search history.

(56) References Cited

U.S. PATENT DOCUMENTS

| | | | | |
|---|---|---|---|---|
| 6,273,771 | B1 | 8/2001 | Buckley et al. | |
| 6,865,996 | B2 * | 3/2005 | Borrett | 114/144 B |
| 8,807,059 | B1 * | 8/2014 | Samples et al. | 114/144 R |
| 2007/0093147 | A1 | 4/2007 | Mizutani | |
| 2008/0119096 | A1 * | 5/2008 | Ito et al. | 440/87 |
| 2008/0166932 | A1 * | 7/2008 | Kado et al. | 440/1 |
| 2008/0318482 | A1 | 12/2008 | Torrangs et al. | |

FOREIGN PATENT DOCUMENTS

| | | | |
|---|---|---|---|
| EP | 0778196 | A1 | 6/1997 |
| GB | 2457019 | A * | 8/2009 |
| WO | 2007105995 | A1 | 12/2008 |

OTHER PUBLICATIONS

International Search Repoirt (Aug. 22, 2012) for corresponding International Application PCT/SE2012/050154.

European Search Report (Dec. 8, 2015) for corresponding European App. EP 12 86 8409.

* cited by examiner

*Primary Examiner* — Michael J Zanelli
(74) *Attorney, Agent, or Firm* — WRB-IP LLP

(57) ABSTRACT

A marine propulsion control system for controlling a set of propulsion units carried by a hull of a vessel is based on the recognition that simultaneous control of yaw and sway movements can be achieved through a control system for a set of propulsion units where two propulsion units achieve yaw movement and two propulsion units achieve a sway movement.

11 Claims, 4 Drawing Sheets

ROTATION AND TRANSLATION CONTROL SYSTEM FOR VESSELS

BACKGROUND AND SUMMARY

The present invention relates to a control system for docking a marine vessel.

Today's marine vessels are often equipped with a plurality of propulsion units, for example three, for driving the vessel. If every propulsion unit is associated to a separate control lever the handling of the vessel can be unnecessarily complicated. As many users of marine vessels are not experienced helmspersons, a simplified control system is desirable.

WO 2007/05995 describes a control system for a set of propulsion units where a centrally arranged propulsion unit of the set is controlled as a slave based on control signals provided by at least one of the remaining propulsion units of the set. Thereby, the number of control levers are decreased, for example from three to two, thus the control system for the vessel is simplified.

However, there is always a desire to even further simplify the handling of a marine vessel, for example by means of introducing further improvements to the control system for controlling a set of marine propulsion units.

It is desirable to achieve a control system for a set of marine propulsion units, and a marine vessel with such a control system that is further simplified.

The inventor has observed that if the drivelines are paired so that only two steering angles are used to control the propulsion units, namely a first angle for port side propulsion units and a second for the starboard side propulsion units, the yaw and sway movements counteract against each other. The invention is based on the inventor's realization that simultaneous control of yaw and sway movements can be achieved through a control system for a set of propulsion units where two propulsion units achieve yaw movement and two propulsion units achieve a sway movement.

According to a first aspect of the inventive concept, a marine propulsion control system for controlling a set of propulsion units carried by a hull of a vessel, wherein said set of propulsion units comprise a first, a second, a third, and a fourth propulsion unit, said marine propulsion control system comprising a control unit configured to receive an input command from a steering control instrument for operating the vessel, determine a desired delivered thrust, gear selection and steering angle for said first, second, third and fourth propulsion unit respectively, based on the input command, and provide a set of control commands for controlling the desired delivered thrust, gear selection and steering angle for said first, second, third and fourth propulsion unit, wherein if said input command simultaneously indicates a sway and yaw input command said control unit is configured to simultaneously provide at least a first control command to said first and fourth propulsion units and a second control command to said second and third propulsion units, wherein said first control command is adapted to achieve a sway movement of the marine vessel and said second control command is adapted to achieve a yaw movement of said marine vessel.

In the context of this application a "vessel" should interpreted as any type of vessel, such as larger commercial ships, smaller vessel such as leisure boats and other types of water vehicles or vessels.

Furthermore, in the context of this application "gear selection" should be interpreted as selection of rotation direction of the propeller, i.e. forwards or rearwards rotation direction.

Moreover, in the context of this application the terms "sway", "yaw" and "surge" for vessel movements are used.

"Sway" is a linear lateral movement, Le, port or starboard movements, "yaw" is when the vessel rotates about a vertical axis and surge is a linear longitudinal movement, i.e. forward or reverses movements.

Through the system described, the propulsion units can he controlled individually. Thereby the propulsion units may for example be switched independently between a forward propulsion state and a reverse propulsion state and steered independently of one another.

A common solution to facilitate the handling of a vessel in slow speed is to equip the marine vessel with additional propulsion units for the specific purpose of maneuvering the marine vessel at low speeds, such as docking. However, that is a costly solution which increase the total cost of the vessel significantly. The solution presented herein does not affect the total cost of the vessel in the same extend, as the regular propulsion units can be used for handling sway and yaw movements of the vessel.

By said control system, the sway movement does not have to rely on inertia from an earlier sway operation when achieving a yaw, Instead, both a sway and a yaw thrust can be provided at the same time by separating the control of the propulsion units in two channels, where one channel comprises commands for achieving the vessel to sway, and the other channel comprises commands for achieving the vessel to yaw. Each of the channels comprising control commands for at least two propulsion units.

Many inexperienced operators compare operating a marine vessel to operating a land vehicle, e.g. a car, and one of the hardest things to learn is how the marine vessel drifts due to inertial effects, wind and currents, which require the operators to plan their movements long in advance. By allowing the operator to simultaneously moving the vessel in a both a sway and yaw movement the handling of the vessel is vastly facilitated, since an operator of the vessel does not have to plan the vessels movements in several steps.

There are basically four possible combinations of sway and yaw movements for a vessel. All combinations may be accomplished by two propulsion units performing the sway movement and two other propulsion units simultaneously performing the yaw movement.

In the examples below the movements are achieved by four propulsion units, a first propulsion unit arranged as a port side propulsion unit, a second propulsion unit arranged as a port center propulsion unit, a third propulsion unit arranged as a starboard center propulsion t. and a fourth propulsion unit arranged as a starboard side propulsion unit.

The first combination is a port sway and a clockwise yaw. To achieve that movement the port side propulsion unit is set to have a reverse gear selection and a steering angle pointing outwardly from a longitudinal axis, thus providing a thrust with at least a component in the port direction. In the context of this application "a longitudinal axis" should be interpreted as an axis extending from the vessel's bow to the vessel's stern substantially creating a center line that divides the vessel's hull into two substantially symmetrical mirrored portions, Moreover, the port center propulsion unit is set to have a forward gear selection and performing a thrust with at least a force component in parallel to the longitudinal axis and directed towards the how. Further, the starboard center propulsion unit is set to have a reverse gear selection and performing a thrust with at least a component in parallel to the longitudinal axis and directed from the bow. Finally, the starboard propulsion unit is set to have a forward gear selection and a steering angle pointing outwardly from the longitudinal axis, thus providing a thrust with at least a component in the port. direction.

Thereby, the port and starboard propulsion unit will sway the vessel in a port movement and the port center and starboard center propulsion unit will yaw the vessel in a clockwise direction.

The other combinations of sway and yaw movements can be achieved, by simply altering the gear selection (forward/reverse) of the four propulsion units, which will be described in detail later. Moreover, there are of course also combinations of movements where the desired movement of the vessel is a combination of sway, yaw and surge movements, which also will be discussed later.

According, to another embodiment, the second and third propulsion units are intermediately provided between said first and fourth propulsion unit. If the second and third propulsion units are used for achieving a yaw movement of the vessel their steering angle may be substantially parallel with the longitudinal axis. By being intermediately provided between the first and fourth propulsion unit the space around the stern is used most efficiently. If the two propulsion units provided as center propulsion units would be used fix achieving a sway, the propulsion units would have to be provided with more space between them, as the propulsion units achieving a sway need to be non parallel to the longitudinal axis.

According to yet another embodiment, the first and fourth propulsion units steering angles are substantially inverted relative a longitudinal axis.

In one embodiment of the invention the first and fourth propulsion unit angles are set to outwards angles compared to the longitudinal axis.

By utilizing the two outer propulsion units, i.e. the first and fourth propulsion unit, for achieving the sway movement the propulsion units can be set to have an outwards angle without interfering with an adjacent propulsion unit. Thereby, a larger steering angle relative the longitudinal axis can be set for the first and fourth propulsion units. Thereby a component force in the lateral axis achieving a sway movement of the vessel is provided.

In another embodiment the first and fourth propulsion unit angles are set to a substantially maximum outwards angle. Thereby, the component force in the lateral axis achieving a sway movement of the vessel is maximize.

In yet another embodiment the steering angles of the second and third propulsion units are substantially the same. In one embodiment, the steering angles of the second and third propulsion units are substantially parallel to the longitudinal axis in a horizontal plane. Thereby, the thrust provided by the second and third propulsion units are directed along a longitudinal axis, thus affecting the yaw movement but not the sway movement of the marine vessel.

According to yet another embodiment, the first control command to said first and fourth propulsion units is configured to set one of said first and fourth propulsion units in a forward gear selection and the other one in a reverse gear selection. Thereby, the force components parallel to the longitudinal axis may be zero, thus leaving a force component parallel to a lateral axis that will achieve a sway movement of the vessel. If a surge movement is also desirable, the force component parallel to the longitudinal axis may be larger than zero.

According to another embodiment of the inventive concept the second control command to said second and third propulsion units is configured to set one of said second and third propulsion units in a forward gear selection and the other one is in a reverse gear selection. Thereby, the force components parallel to the longitudinal axis ma be set to zero by adjusting the thrust of the second and third propulsion units, thus leaving a moment force for achieving a yaw without moving the vessel in a surge movement.

According to yet another embodiment, the marine propulsion control system further comprises four independent ECUs for providing, an interface between said control unit and said first, second, third and fourth propulsion unit respectively. Thereby, the control unit does not have to comprise an interface for communicating with the first, second and third propulsion unit, Moreover, existing ECUs in a marine vessel can be utilized.

According to another embodiment of the inventive concept the second control command to said second and third propulsion units is configured to set one of said first and fourth propulsion units in a forward gear selection and the other one is in a reverse gear selection. Thereby, the force components parallel to the longitudinal axis may be set to zero by adjusting the thrust of the second and third propulsion units, this leaving a moment force for achieving a yaw without moving the vessel in a surge movement According to vet another embodiment, the marine propulsion control system further comprises four independent ECUs for providing, an interface between said control unit and said first, second, third and forth propulsion unit respectively. Thereby, the control unit does not have to comprise an interface for communicating with the first, second and third propulsion unit. Moreover, existing ECUs in a marine vessel can be utilized.

According to yet another embodiment, the four independent ECUs being electrically connected to said control unit.

According to yet another embodiment, the marine propulsion control system further comprises a steering control instrument for providing said control unit with an input command. Thereby, the operator can easily provide input commands to the control unit, so that the control unit can control the propulsion units in a direction desired by the operator.

Preferably, the inventive control system forms part of a marine vessel, further comprising a first propulsion unit, a second propulsion unit, a third propulsion unit, a fourth propulsion unit, wherein each propulsion unit being carried by a hull.

The effects of a vessel as described above are largely analogous to the effects of a marine propulsion control system as described above. By providing a vessel with a marine propulsion control the sway movement, does not have to rely on inertia from an earlier sway operation when achieving a yaw. Instead, both a sway and a yaw thrust can be provided at the same time by separating the control of the propulsion units in two channels, where one channel comprises commands for achieving the vessel to sway, and the other channel comprises commands for achieving the vessel to yaw. Each of the channels comprising control commands for at least two propulsion units. A vessel according to above vastly facilitates the control of the vessel.

According to a second aspect of the present inventive concept, a method for controlling a set of propulsion units carried by a hull of a vessel, wherein said set of propulsion units comprise a first a second, a third, and a fourth propulsion unit, said method comprising receiving an input command from a steering control instrument operating the vessel, determining a desired delivered thrust, gear selection and steering angle for said first, second, third and fourth propulsion unit respectively, based on the input command, providing a set of control commands for controlling the desired delivered thrust, gear selection and steering angle for said first, second, third and fourth propulsion unit, and simultaneously providing at least a first control command to said first and fourth propulsion units and a second control command to said second and third propulsion units, if said input command simultaneously indicates a sway and yaw input command, wherein said first control command is adapted to achieve a sway movement of the marine vessel and said second control command is adapted to achieve a yaw movement of said marine vessel.

The effects of a vessel as described above are largely analogous to the effects of a marine propulsion control system, and a vessel as described above. By providing the method to control the set of propulsion units sway movement does not have to rely on inertia from an earlier sway operation when achieving a yaw. Instead, both a sway and a yaw thrust can be provided at the same time by separating the control of the propulsion units in two channels, where one channel comprises commands for achieving the vessel to sway, and the other channel comprises commands for achieving the vessel to yaw. Each of the channels comprising control commands for at least two propulsion units. The method according to above vastly facilitates the control of a vessel.

According to a third aspect of the present invention there is provided a computer program product comprising a computer readable medium having stored thereon computer program means for causing a control unit to control a set of propulsion units carried by a hull of a vessel, wherein said set of propulsion units comprise a first, a second, a third, and a fourth propulsion unit, wherein the computer program product comprises code for receiving an input command from a steering, control instrument operating the vessel, code for determining a desired delivered thrust, gear selection and steering angle for said first, second, third and fourth propulsion unit respectively, based on the input command, code for providing a set of control commands for controlling the desired delivered thrust, gear selection and steering angle for said first, second, third and fourth propulsion unit, and code for simultaneously providing at least a first control command to said first and fourth propulsion units and a second control command to said second and third propulsion units, if said input command simultaneously indicates a sway and yaw input command, wherein said first control command is adapted to achieve a sway movement of the marine vessel and said second control command is adapted to achieve a yaw movement of said marine vessel.

The control is preferably a micro processor or similar device, and the computer readable medium may be one of a removable nonvolatile random access memory, a hard disk drive, a floppy disk, a CD-ROM, a DVD-ROM, a USB memory, an SD memory card, or a similar computer readable medium known in the art. The effects of a the computer product implementation of the invention for controlling a set of propulsion units b a control unit as described above are largely analogous to the effects of a marine propulsion control system, vessel and method as described above.

Furthermore, a code for controlling a set of marine propulsion units allows a user to upgrade an existing marine propulsion control system that allows separate individual control of the steering angle, thrust level and gear selection of the set or propulsion units. With abovementioned code, the upgrade could be done carried out with merely software alterations, vastly reducing the costs for a vessel owner to upgrade the marine propulsion control system.

BRIEF DESCRIPTION OF DRAWINGS

Embodiments of the invention will in the following be described, in more detail with reference to the enclosed drawings, wherein.

DETAILED DESCRIPTION

Figure 1:
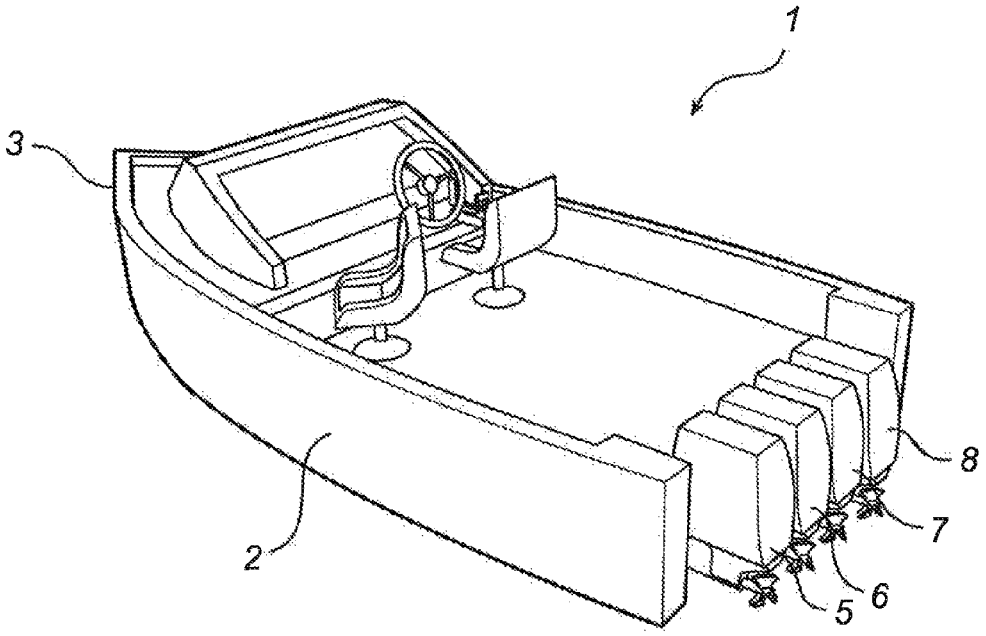
FIG. 1 schematically illustrates a perspective-view of a marine vessel comprising a marine propulsion control system configured to control four propulsion units.

The present invention will be described more fully hereinafter with reference to the accompanying drawings, in which preferred embodiments of the invention are shown. The inventive concept may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

In the description below a control system for a set of marine propulsion units wherein the input means is a joystick, is mainly discussed. It should however be noted that this by no means should limit the scope of the application which is equally applicable on a control system where the input means is a stick, a set of buttons, a touch screen or equivalent.

Moreover, a control system for a set of marine propulsion units comprising four propulsion units is mainly discussed. It should however be noted that this by no means should limit the scope of the application, which is equally applicable on a set of marine propulsion u comprising any number of propulsion units exceeding three.

Furthermore, a control system for a set of marine propulsion units comprising four Engine Control Units (ECUs) is mainly discussed. It should however be noted that this by no means should limit the scope of the inventive concept, which is equally applicable on a control system where a control unit internally comprise the functionality of the ECUs.

FIG. 1 shows a simplified top view of a marine vessel I in which the marine propulsion control system 9 according to an embodiment of the inventive concept can be used. Generally, the control system according to an embodiment of the inventive concept may be used in any type of vessel, such as larger commercial ships, smaller vessel such as leisure boats and other types of water vehicles or vessels. The invention is particularly useful for small leisure boats, but it is nevertheless not limited to such type of water vehicle only.

As further schematically illustrated in FIG. 1 the vessel 1 may be designed with a hull 2 having a bow 3, a stern 4 and being divided into two symmetrical portions by a thought centre line running from the bow 3 to the stern 4. In the stem 4, tour propulsion units 5, 6, 7 and 8 may be mounted. More precisely, the vessel 1 may be provided with a first propulsion unit 5 arranged at the port side, a second propulsion unit 6 arranged in the port centre, a third propulsion unit 7 arranged at the starboard center and a fourth propulsion unit 8 arranged at the starboard side. The propulsion units 5, 6, 7 and 8 may be pivotally arranged in relation to the hull 2 for generating a driving thrust in a desired direction of a generally conventional kind. The propulsion units may alternatively be inboard propulsion units, mounted under the boat on the hull 2, or mourned on the stern 4 as so called stemdrives. That is, the propulsion units 5, 6, 7 and 8 may be outboard propulsion units or inboard propulsion units.

Figure 2:
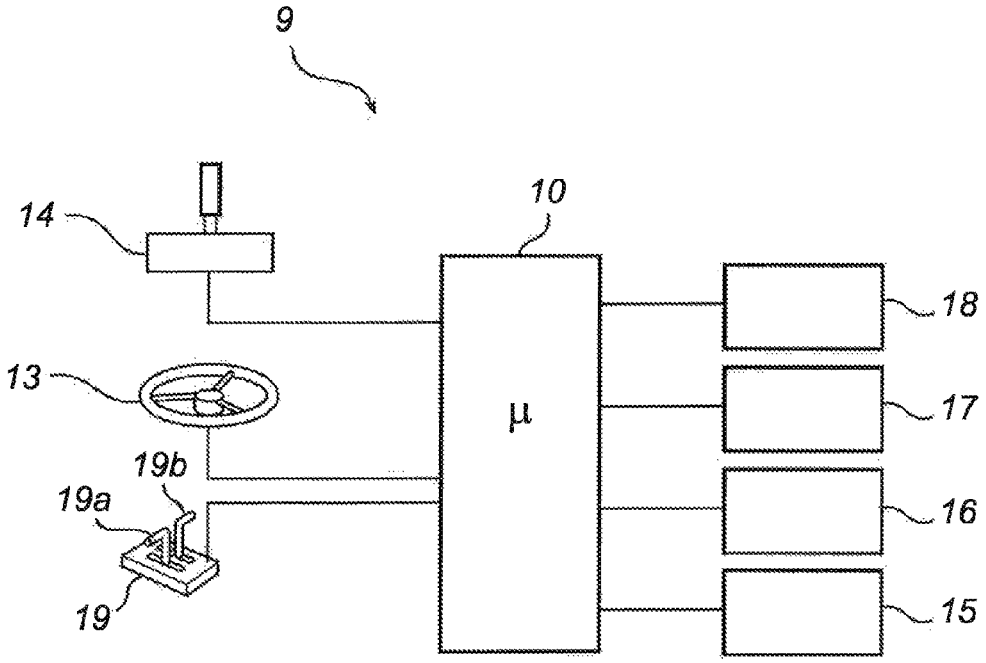
FIG. 2 illustrates a scheme of a control system for a set of marine propulsion units.

The control of the propulsion units are performed by a marine propulsion control system 9 as further illustrated in FIG. 2.

FIG. 2 is a scheme diagram showing the scheme of a marine propulsion control system 9 according to one embodiment, The control system includes a control unit 10, steering control instruments such as a joystick 14, a steering wheel 13 and/or a thrust regulator 19, and a first 15, second 16, third 17 and fourth 18 Engine Control Unit (ECU). The first 15, second 16, third 17 and fourth 18 ECUs are adapted to control a first 5, second 6 third 7 and fourth 8 propulsion unit, respectively.

According to one implementation, each propulsion unit 5, 6, 7, 8 may include a gear selector, a steering actuator, and a steering angle detecting section. The gear selector may change gear selection for each propulsion unit between a forward propulsion position, a reverse propulsion position, and a neutral position. Alternatively, two gear selectors are provided. One for each group of propulsion units positioned on the starboard side of the thought centre line and one for the group of propulsion units positioned on the port side of the thought centre line.

The steering actuator may turn the propulsion unit about a steering axis and thereby altering the steering angle thrust direction. The steering actuator may include a hydraulic cylinder or an electrical motor. The steering angle detecting section may detect an actual steering angle propulsion unit. If the steering actuator is a hydraulic cylinder, then the steering angle detecting section may be a stroke sensor for the hydraulic cylinder. However, the steering angle detecting section may be any means for measuring or calculating the steering angle.

The control unit 10 contains means for mapping an input signal from the steering control instruments into a reference value angle for respective propulsion unit 5, 6, 7, 8, where the steering actuators are arranged to move the propulsion units such that they assume the reference value angle. The mapping may be of simple type such that a steering angle is obtained from the steering control instruments and that the steering actuator uses this input command as the reference value angle. The mapping may also be more complex such that the reference value angles are calculated in dependence of the driving situation including speed, desired trim angle, whether docking is performed such that sway of the vessel is desired and so forth.

The ECUs may control operations of the associated propulsion units, through controlling the gear selection, delivered thrust and the steering angle. The controlled operations may be based on the input commands from the steering wheel 13, joystick 14 and thrust regulator 19. The ECUs may be connected to the control unit 10 through a communication line. In another embodiment, the ECU is capable of communicating with the control unit 10 wirelessly.

In another embodiment of the invention, the four mentioned ECUs form an integral part of the control unit 10.

Through the system described, the propulsion units 5, 6, 7, can be controlled individually. Thereby the propulsion units may be e.g. switched independently between a forward propulsion state and a reverse propulsion state and steered independently of one another.

The thrust regulator 19 comprises port throttle lever 19*a*, and a starboard throttle lever 19*b* arranged to generate a desired delivered thrust by the propulsion units contributing to the thrust on the port and starboard side respectively. When a throttle lever 19*a*, 19*b* is tilted forward/backwards a detection signal is transmitted to the control unit 10 comprising the desired gear selection, i.e. forward/reverse, and a thrust level associated with the angle that the throttle lever 19*a*, 19*b* is tilted with relative a neutral position. The port throttle lever 19*a* is primarily intended for the first 5 and second 6 propulsion unit and the starboard throttle lever 19*b* for the third 7 and fourth 8 propulsion unit when traveling in high speed.

Gear selectors and throttle lever units are previously known as such, and for this reason they are not described in detail here. Based on received information from the steering control instruments 13, 14, 19 the control unit 10 is arranged to control the propulsion units 5, 6, 7, 8 in a suitable manner to propel the vessel 1 with a requested direction and thrust.

The joystick 14 may be adapted to primarily be used to control the vessel in low speed. The joystick 14 may supply the control unit 10 with input commands comprising, any combinations of translational movements, such as sway, surge, and yaw movements. Thus, a user may through the joystick 14 supply the control unit with an input command comprising e.g. port sway and clockwise yaw.

The joystick 14 may be tilted in at least four directions; forward, rearward, leftward, and rightward. Thus, the direction may be operated so as to issue input commands in at least forward or reverse surge, left or right sway movement of the vessel 1. Moreover, the joystick 14 may also be rotatable operated so as to issue an operating instruction for achieving a yaw movement of the vessel 1. In one embodiment this is accomplished by rotating the joystick about a central vertical axis. When the joystick is altered from its neutral position a detection signal is transmitted to the control unit 10. For example, when an operator tilts the joystick to the port side and rotates it clockwise the propulsion units are controlled such that the hull 2 moves in a sway movement translational to the port side with a clockwise rotation. As described above, there are only four basic combinations of sway and yaw movements.

In one embodiment the control unit 10 comprises computing means such as a CPU or other processing device, and storing means such as a semiconductor storage section, e.g., a RAM or a ROM, or such a storage device as a hard disk or a flash memory. The storage section can store settings and programs or schemes for interpreting input commands and generation control commands for controlling the propulsion units.

The control unit 10 controls a forward/reverse propulsion direction, a desired thrust, i.e. propulsion force, and a desired steering angle of each of the propulsion units individually in accordance with input commands from the steering control instruments 13, 14, and 19, The desired thrust of the propulsion units correspond to a target engine rotational speed. Thus, controlling the thrust often means controlling a propeller rotational speed.

In one embodiment the thrust regulator 19 includes a single starboard input command and a single port input command for each function that is under control by the thrust regulator. As have been explained above, these functions may include port and starboard throttle levers and port and starboard gear selectors.

Figure 3A:
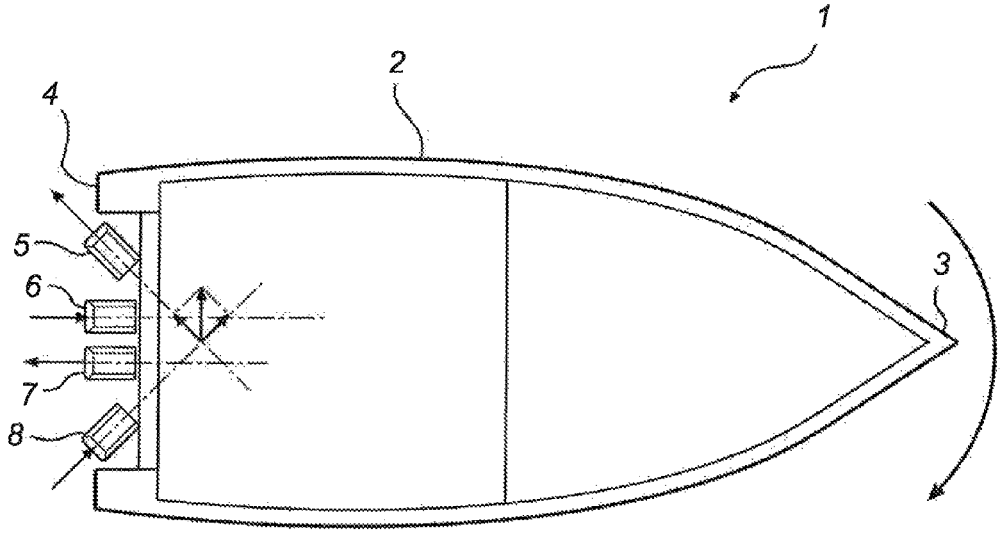
FIG. 3*a* schematically illustrates a top-view of a marine vessel comprising a marine propulsion control system configured to control four propulsion units FIG. 3*b* schematically illustrates a top-view of a marine vessel comprising a marine propulsion control system configured to control four propulsion units.
Figure 3B:
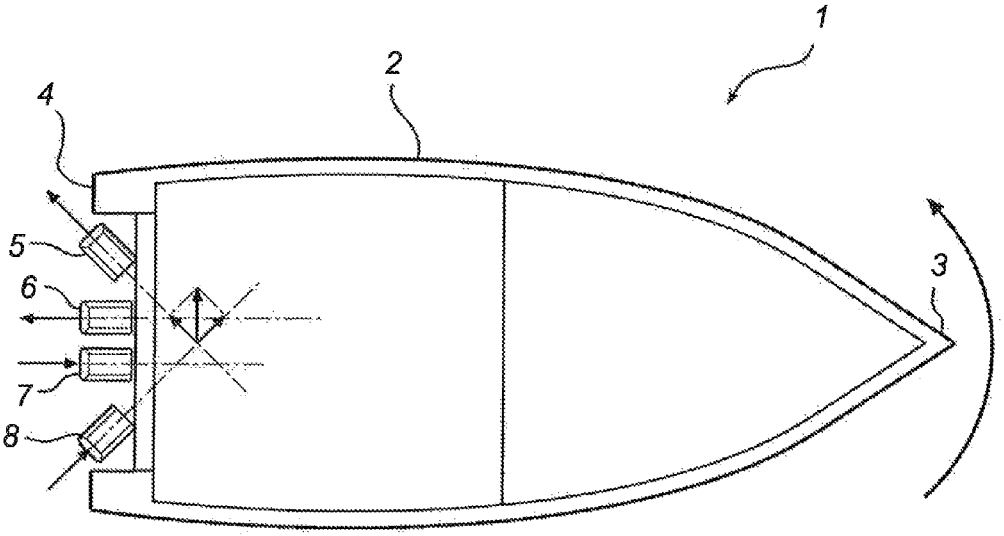
FIG. 3*c* schematically illustrates a top-view of a marine vessel comprising a marine propulsion control system configured to control four propulsion units.
FIG. 3*d* schematically illustrates a top-view of a marine vessel comprising, a marine propulsion control system configured to control four propulsion units.
Figure 3C:
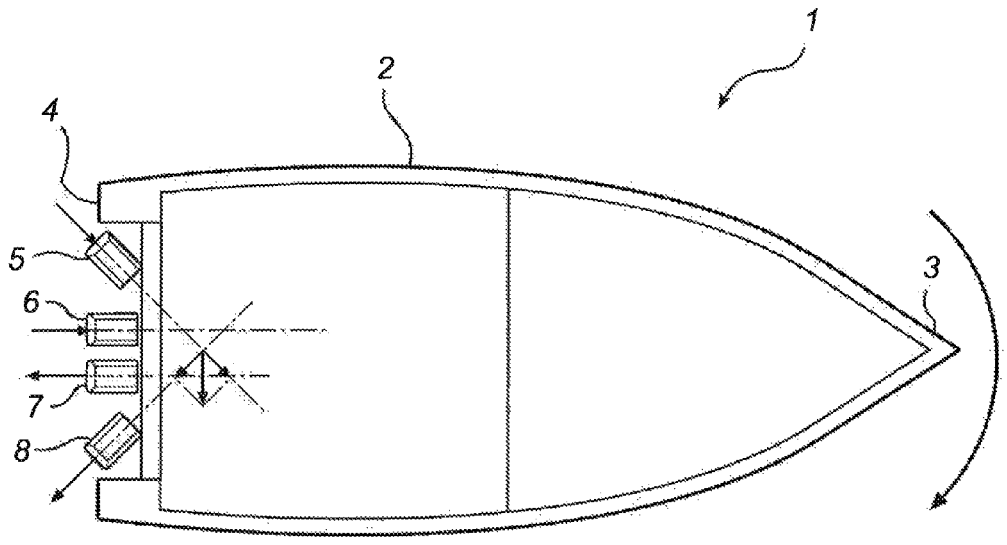
Figure 3D:
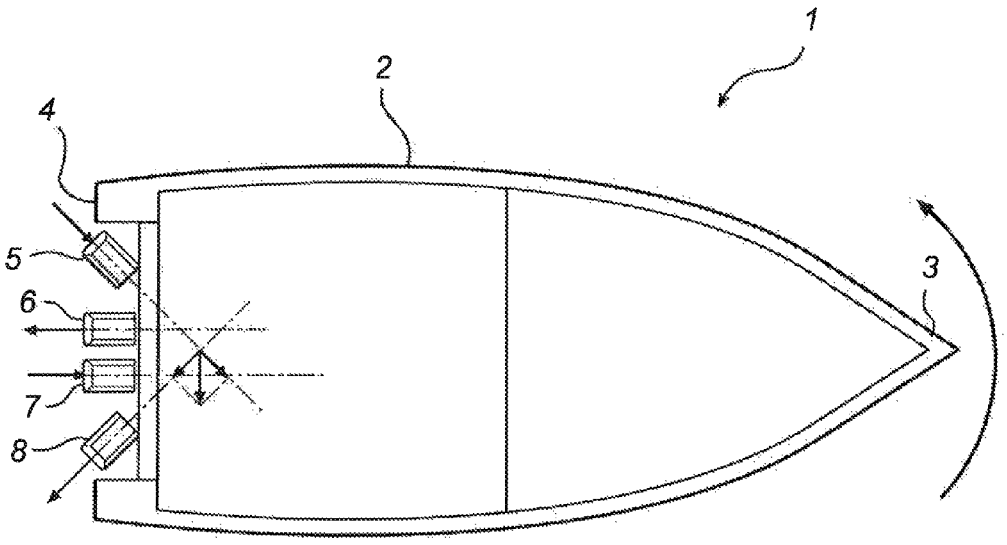

FIG. 3*a,* FIG. 3*b*, FIG. 3*c* and FIG. 3*d* illustrate the four combinations of sway and yaw movements of a vessel. All combinations illustrated may be accomplished by two propulsion units 5, 8 performing the sway movement and two other 6, 7 propulsion units simultaneously performing the yaw movement. However, there could be additional propulsion units assisting in either the sway or yaw movement, or achieving a surge movement.

In the examples below the movements are achieved by four propulsion units, a first propulsion unit 5 arranged as a port side propulsion unit, a second propulsion unit 6 arranged as a port center propulsion unit, a third propulsion unit 7 arranged as a starboard center propulsion unit and a fourth propulsion unit 8 arranged as a starboard side propulsion unit.

The first combination is a port sway and a clockwise yaw as illustrated in FIG. 3*a*. To achieve that movement the port side propulsion unit 5 is set to have a reverse gear selection and a steering angle pointing outwardly from a longitudinal axis, thus providing a thrust with at least a component in the port direction. Moreover, the port center propulsion unit 6 is set to have a forward gear selection and performing, a thrust with at least a force component in parallel to the longitudinal axis and directed towards the bow. Further, the starboard center propulsion unit 7 is set to have a reverse gear selection and performing a thrust with at least a component in parallel to the longitudinal axis and directed from the bow having. Finally, the starboard propulsion unit 8 is set to have a forward gear selection and a steering angle pointing, outwardly from the longitudinal axis, thus providing a thrust with at least a component in the port direction.

Thereby, the port 5 and starboard 8 propulsion units will sway the vessel in a port movement and the port center 6 and starboard center 7 propulsion units will yaw the vessel in a clockwise direction.

In one embodiment, the port center 6 and starboard center 7 propulsion units are slightly angled inwards to achieve they yaw movement.

In another embodiment, the port 5 and starboard 8 propulsion units may be used to achieve a yaw movement of the vessel and the port center 6 and starboard center 8 propulsion units may be used to achieve a sway movement of the vessel.

In the second sway and yaw combination movement, the vessel should sway in a port direction and yaw counterclockwise as illustrated in FIG. 3*b*. To achieve that, the only difference from the first combination is that the port center propulsion unit 6 will be set to have a reverse gear selection and the starboard center propulsion unit 7 will be set to have a forward gear selection, thus changing the yaw direction to counterclockwise.

In the third sway and yaw combination movement, the vessel should sway in a starboard direction and yaw clockwise as shown in FIG. 3*c*. To achieve that, the only difference from the first combination is that the port propulsion unit 5 will he set to have a forward gear selection and the starboard propulsion unit 8 will be set to have a reverse gear selection, thus changing the sway direction to starboard.

In the fourth and last combination of a sway and yaw movement, the vessel should sway in a starboard direction and yaw counterclockwise. To achieve that, all propulsion units 5, 6, 7, 8 should alter the gear selection so that the port center propulsion unit 6 will be set to have a reverse gear selection, the starboard center propulsion unit 7 will be set to have a forward gear selection, the pun propulsion unit 5 will be set to have a forward gear selection and the starboard propulsion unit 8 will be set to have a reverse gear selection, thus changing both the sway and yaw direction of the vessel to starboard and counterclockwise.

Moreover, there are of course also combinations of movements where the desired movement of the vessel is a combination of sway, yaw and surge movements. In these combinations it is possible for the first 5 and fourth 8 propulsion units to be set have the same gear selection. For example, if the desired movement, is a port sway, clockwise yaw and forward surge, the difference from the first combination explained above could be that the port propulsion unit 5 is set to have a forward gear selection. However, since the speed of the vessel often is limited when a sway movement is desired, it is more probable that the surge movement would be achieved by providing different amount of thrust to the first 5 and the fourth 8 propulsion unit respectively, so that a force component parallel to the longitudinal axis is achieved.

The same principal as described above can be applied to vessels comprising any number of propulsion units above three, where one set of propulsion units are used for a sway movement and another set of propulsion units are used for a yaw movement of the vessel.

Figure 4:
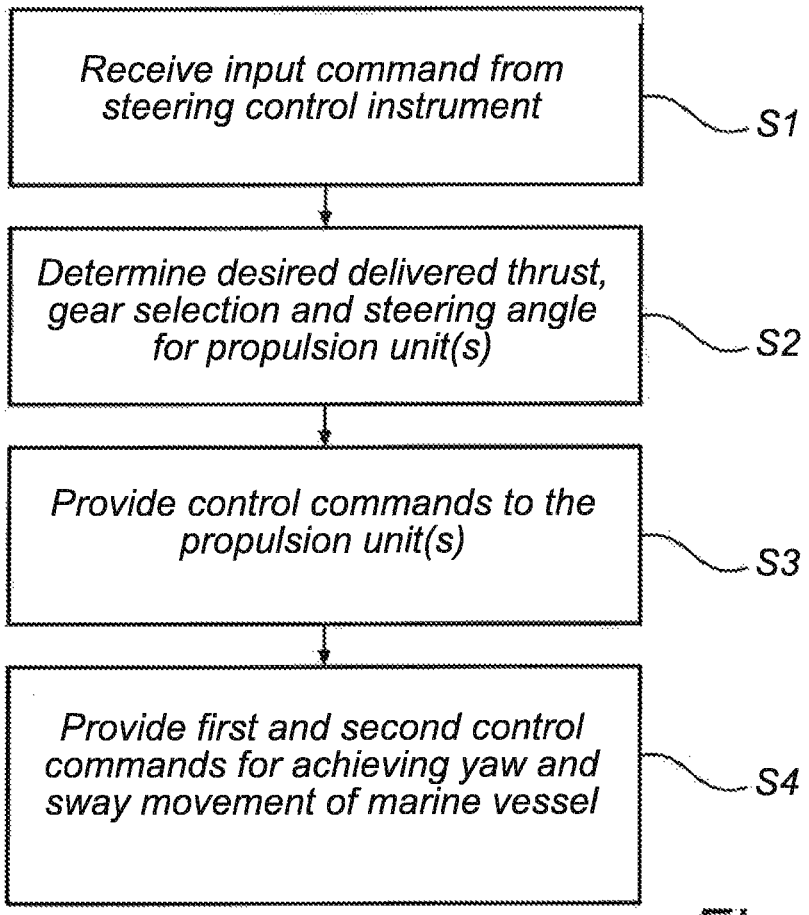
FIG. 4 is a flow-chart illustrating a method for controlling a set of propulsion units.

FIG. 4 is a block. diagram showing the method for controlling the set of propulsion units 5, 6, 7, 8 as described above wherein the method comprises receiving an input command S1 from a steering control instrument, such as the steering wheel 13, joystick 14 and/or thrust regulator 19 operating the vessel Further the method comprises determining a desired delivered thrust, gear selection and steering angle S2 for the first 5, second 6, third 7 and fourth 8 propulsion unit respectively, based on the input command, and thirdly providing a set of control commands for controlling the desired delivered thrust, gear selection and steering angle S3 for the first 5, second 6, third 7 and fourth 8 propulsion unit. Further the method comprises simultaneously providing at least a first control command to said first 5 and fourth 8 propulsion units and a second control command to said second 6 and third 7 propulsion units, if said input command simultaneously indicates a sway and yaw input command, wherein said first control command is adapted to achieve a sway movement of the marine vessel and said second control command is adapted to achieve a yaw movement of said marine vessel.

While the present invention has been described with reference to a number of preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiments disclosed as the best mode contemplated for carrying out this invention, but that the invention will include all embodiments falling within the scope of the appended claims.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A marine propulsion control system controlling a set of propulsion units carried by a hull of a vessel, wherein the set of propulsion units comprise a first, a second, a third, and a fourth propulsion unit, the marine propulsion control system comprising a control unit configured to:

receive an input command from a steering control instrument for operating the vessel;

determine a desired delivered thrust, gear selection and steering angle for the first, second, third and fourth propulsion unit respectively, based on the input command, and provide a set of control commands for controlling the desired delivered thrust, gear selection and steering angle for the first, second, third and fourth propulsion unit, wherein if the input command simultaneously indicates a sway and yaw input command the control unit is configured to simultaneously provide at least a first control command to the first and fourth propulsion units and a second control command to the second and third propulsion units, wherein the first control command is adapted to achieve a sway movement of the marine vessel and the second control command is adapted to achieve a yaw movement of the marine vessel.

2. Marine propulsion control system according to claim 1, wherein the second and third propulsion units are intermediately provided between the first and fourth propulsion unit.

3. Marine propulsion control system according to claim 1, wherein the first and fourth propulsion units steering angles are substantially inverted relative a longitudinal axis.

4. Marine propulsion control system according to claim 1, wherein the first control command to the first and fourth propulsion units is configured to set one of the first and fourth propulsion units in a forward gear selection and the other one in a reverse gear selection.

5. Marine propulsion control system according to claim 1, wherein the second control command to the second and third propulsion units is configured to set one of the second and third propulsion units in a forward gear selection and the other one is in a reverse gear selection.

6. Marine propulsion control system according to claim 1, further comprising four independent ECU for providing an interface between the control unit and the first, second, third and fourth propulsion unit respectively.

7. Marine propulsion control system according to claim 6, wherein the four independent ECU being electrically connected to the control unit.

8. Marine propulsion control system according to claim 1, further comprising a steering control instrument for providing the control unit with an input command.

9. A marine vessel, comprising:

a first propulsion unit;

a second propulsion unit;

a third propulsion unit;

a fourth propulsion unit, each propulsion unit being carried by a hull of the vessel, and a marine propulsion control system according to claim 1 for controlling the first, the second third and fourth propulsion unit.

10. A method for controlling a set of propulsion units carried by a hull of a vessel, wherein the set of propulsion units comprise a first, a second, a third, and a fourth propulsion unit, the method comprising:

receiving an input command from a steering, control instrument operating the vessel;

determining a desired delivered thrust, gear selection and steering angle for the first, second, third and fourth propulsion unit respectively, based on the input command, providing a set of control commands for controlling the desired delivered thrust, gear selection and steering angle tot the first, second, third and fourth propulsion unit, and simultaneously providing at least a first control command to the first and fourth propulsion units a id a second control command to the second and third propulsion units, if the input command simultaneously indicates a sway and yaw input command, wherein the first control command is adapted to achieve a sway movement of the marine vessel and the second control command is adapted to achieve a yaw movement of the marine vessel.

11. Computer program product comprising a computer readable medium having stored thereon computer program means for causing a control unit to control a set of propulsion units carried by a hull of a vessel, wherein the set of propulsion units comprise a first, a second, a third, and a fourth propulsion unit, wherein the computer program product comprises:

code for receiving an input command from a steering control instrument operating the vessel;

code for determining a desired delivered thrust, gear selection and steering angle for the first, second, third and fourth propulsion unit respectively, based on the input command, code for providing a set of control commands for controlling the desired delivered thrust, gear selection and steering angle for the first, second, third and fourth propulsion unit, and code for simultaneously providing at least a first control command to the first and fourth propulsion units and a second control command to the second and third propulsion units, if the input command simultaneously indicates a sway and yaw input command, wherein the first control command is adapted to achieve a sway movement of the marine vessel and the second control command is adapted to achieve a yaw movement of the marine vessel.

* * * * *